United States Patent [19]

Thom

[11] Patent Number: 4,713,035

[45] Date of Patent: Dec. 15, 1987

[54] TOY TELEPHONE

[75] Inventor: Paul Thom, Woburn, Mass.

[73] Assignee: Kiddie Products, Inc., Avon, Mass.

[21] Appl. No.: 898,330

[22] Filed: Aug. 20, 1986

[51] Int. Cl.[4] ..... A63H 33/30

[52] U.S. Cl. ..... 446/141; 446/142; 446/418

[58] Field of Search ..... 446/141, 142, 418, 420

[56] References Cited

U.S. PATENT DOCUMENTS

| | | | |
|---|---|---|---|
| 330,681 | 11/1885 | Depp | 446/418 |
| 1,808,036 | 6/1931 | Hill | 446/141 |
| 1,888,802 | 11/1932 | Jansen . | |
| 1,975,893 | 10/1934 | Conklin . | |
| 1,996,642 | 4/1935 | Conklin | 446/142 |
| 1,999,001 | 4/1935 | Allen | 446/142 |
| 2,066,065 | 12/1936 | Bregman | 446/142 |
| 2,110,380 | 3/1938 | Lohr | 446/142 |
| 2,159,839 | 5/1939 | Bregman . | |
| 2,533,327 | 12/1950 | Richards . | |
| 2,634,647 | 4/1953 | Loeffler et al. | 446/141 |
| 3,305,966 | 2/1967 | Thornell . | |
| 3,548,536 | 12/1970 | Glass et al. . | |
| 4,266,365 | 5/1981 | Cummings et al. | 446/142 |

FOREIGN PATENT DOCUMENTS

| | | | |
|---|---|---|---|
| 1223283 | 8/1966 | Fed. Rep. of Germany | 446/141 |

*Primary Examiner*—Victor N. Sakran

[57] ABSTRACT

A toy telephone having a base, a dial connected to the base and noise generating means within the base actuatable by the dial, characterized in that the dial is connected to the base for both rotary and axial motion relative to the base and the noise generating means within the base is actuatable to generate one noise upon rotary actuation and a different noise upon axial actuation of the dial.

13 Claims, 9 Drawing Figures

FIG 5
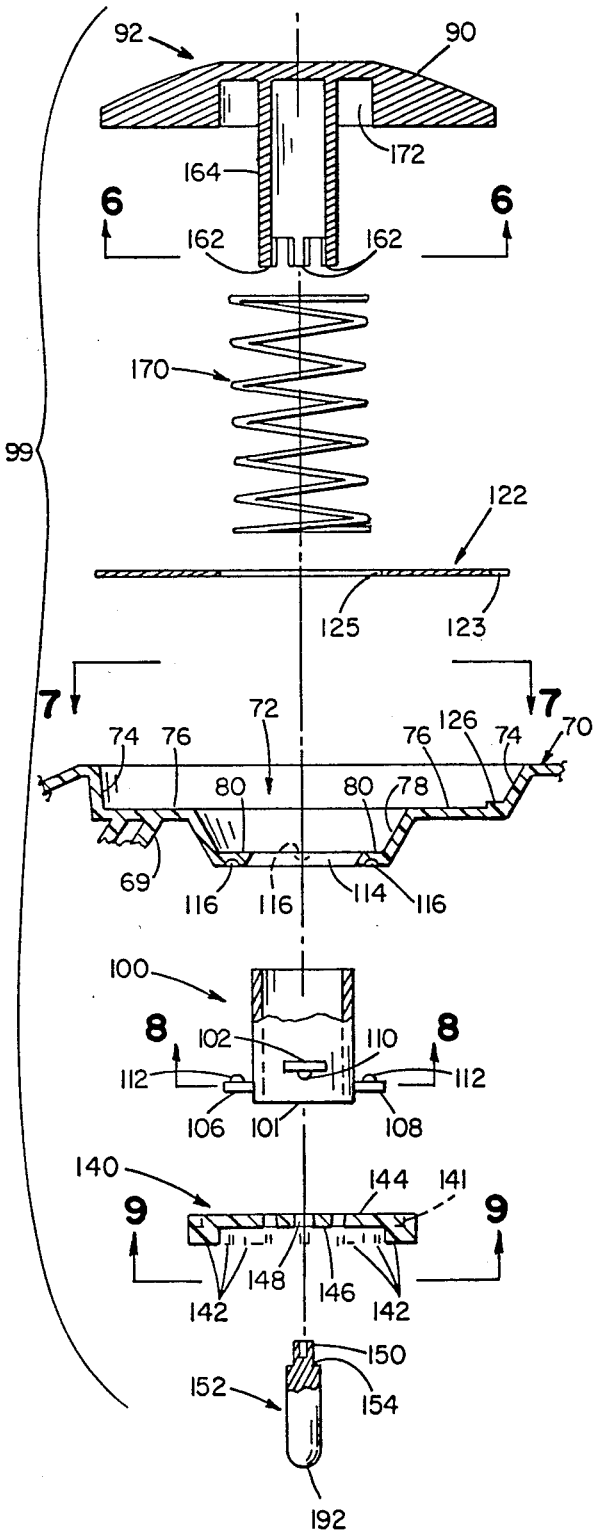
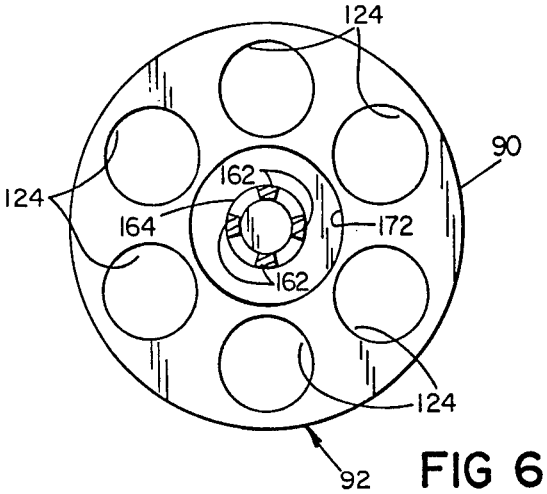
FIG 6
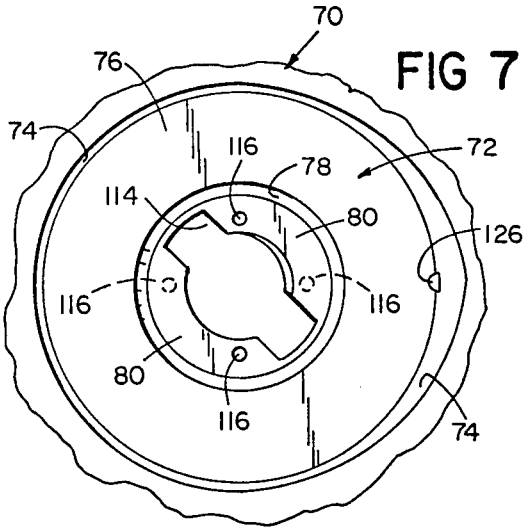
FIG 7
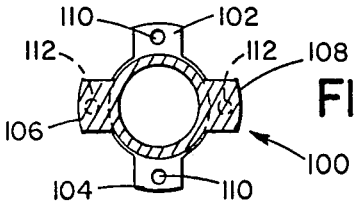
FIG 8
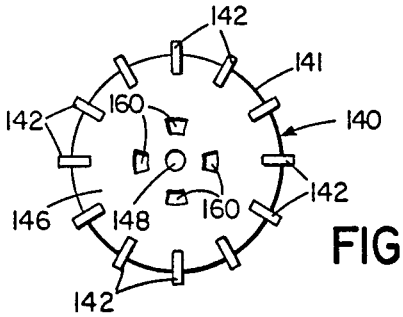
FIG 9

TOY TELEPHONE

BACKGROUND OF THE INVENTION

This invention relates generally to toy telephones, and particularly to the noise generating mechanism of toy telephones.

Children find especially pleasing toys that make noises and that are simple to manipulate. Children also like to play with toys which imitate objects used by adults.

It is an object of the present invention to provide a toy telephone with a single noisemaking mechanism that produces two distinct sounds, and that is, at the same time, mechanically simple for a child to operate, and provides sturdy mechanical reliability.

SUMMARY OF THE INVENTION

In general, the invention features a toy telephone having a base, a dial connected to the base and noise generating means within the base actuatable by the dial, characterized in that the dial is connected to the base for both rotary and axial motion relative to the base and the noise generating means within the base is actuatable to generate one noise upon rotary actuation and a different noise upon axial actuation of the dial.

In preferred embodiments, the toy telephone is further characterized in that noise generating means is a flexible reed mounted within the base that is engaged by a plurality of tabs connected within the base to the dial for rotation with the dial; the tabs are integral with a disk connected within the base to the dial; noise generating means is a bell mounted within the base to be struck by a striker connected within the base to the dial, actuated by depression of the dial; a spring between the dial and the base biases the dial away from the base.

DESCRIPTION OF THE PREFERRED EMBODIMENT

We first briefly describe the drawings.

Drawings

FIG. 5 is an exploded side view, partially in section, of a toy telephone noisemaking, rotary dial assembly;

FIG. 6 is a bottom sectional view of the dial of FIG. 5 viewed along the line 6—6 of FIG. 5;

FIG. 7 is a fragmentary plan view of a dial receiving recess in the telephone base, comprising part of the assembly of FIG. 5, viewed along the line 7—7 of FIG. 5;

FIG. 8 is a sectional view along the line 8—8 of FIG. 5 of a guide bushing; and

FIG. 9 is a plan view along the line 9—9 of FIG. 5 of a clicker disc.

Structure

Figure 1:
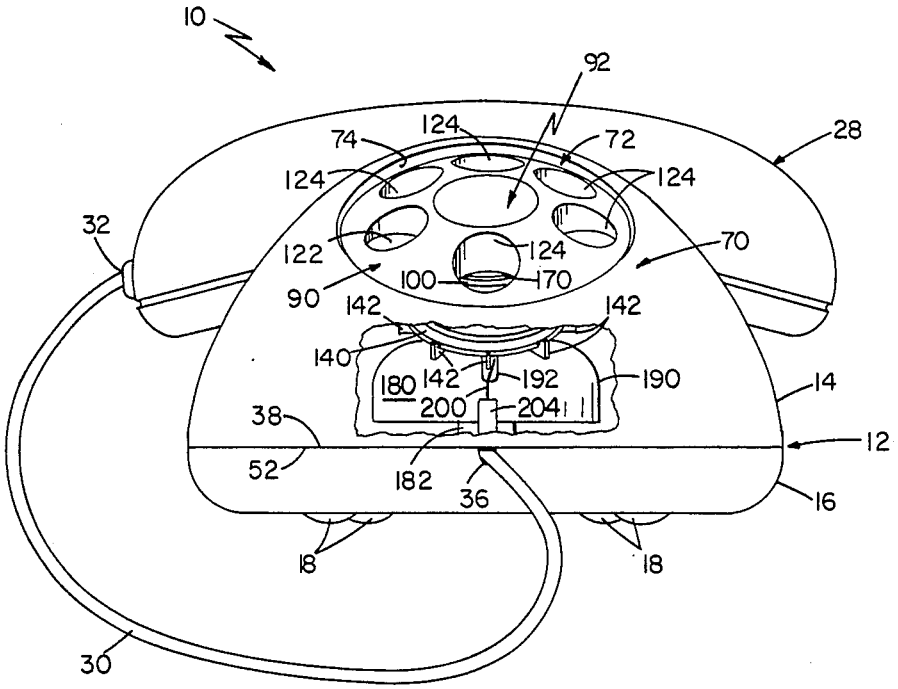
FIG. 1 is a front elevation of a toy telephone, partly broken away.
Figure 3:
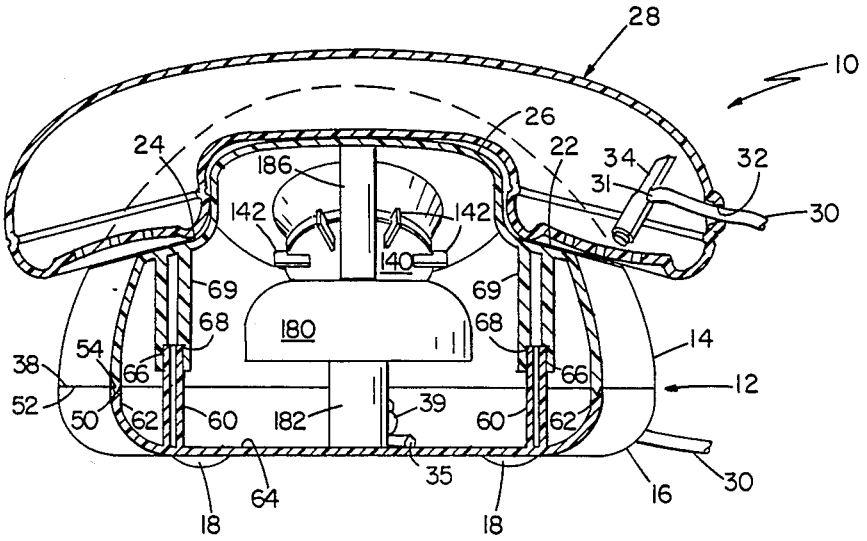
FIG. 3 is a sectional view of the toy telephone base taken along the line 3—3 of FIG. 2 and of the handset, illustrated in FIG. 1, resting on the base.
Figure 2:
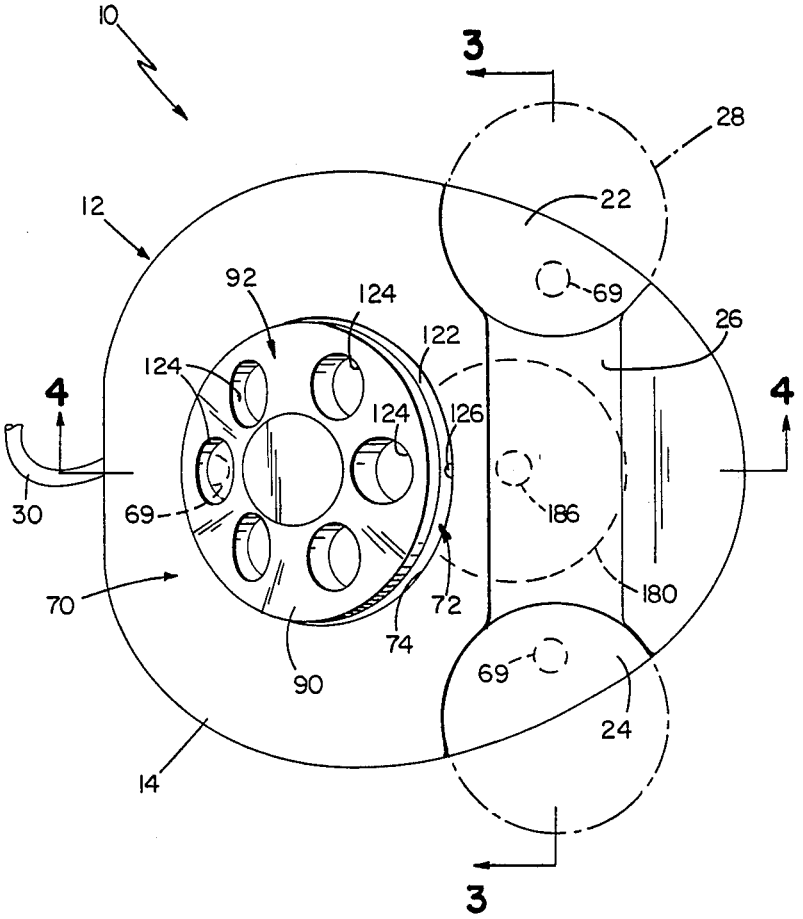
FIG. 2 is a plan view of a toy telephone base.

Referring to the drawings, particularly FIGS. 1, 2 and 3, toy telephone 10 has a base 12 that has an injection molded plastic top 14 and an injection molded plastic bottom 16, which has hemispherical feet 18 for resting base 12 on, e.g., a floor or table. Base top 14 has shoulders 22, 24 and shelf rest 26 (FIG. 2) to cradle handset 28.

Figure 4:
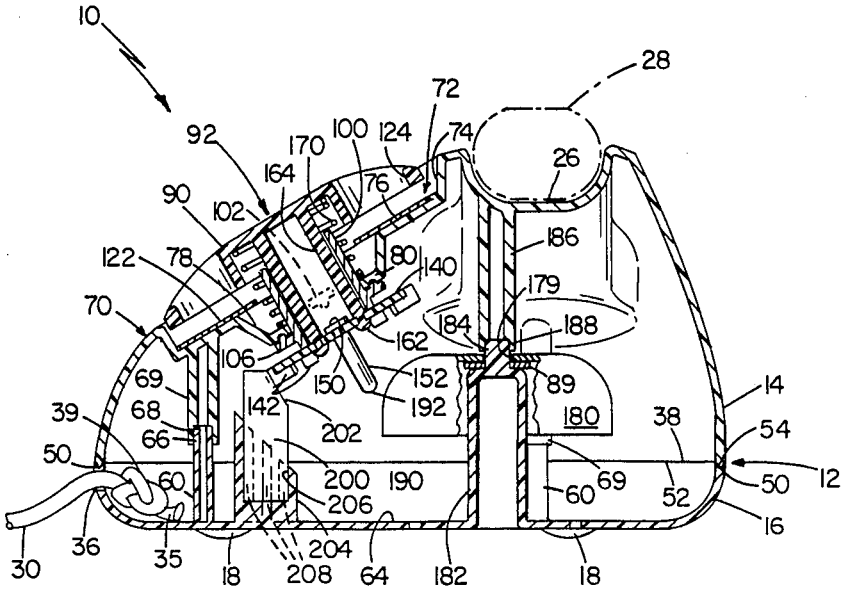
FIG. 4 is a sectional view of the toy telephone base, taken along line 4—4 of FIG. 3.

A blow molded plastic handset 28 is interconnected to base 12 by cord 30, an end 31 of which is inserted into handset 28 via port 32 and secured inside handset 28 by cord anchor 34, which is crimped about end 31, thus preventing the cord from being pulled back out through port 32. As shown in FIGS. 1 and 4, the other end 34 of cord 30 extends through a semicircular port 36 in bottom 16, and end 35 is secured within base 16 by, e.g., a knot 39 tied at the end of the cord 30.

As shown in FIG. 3, top 14 has a tongue 50 that is disposed along its lower edge 52 that mates with a corresponding groove 54 disposed along the upper edge 38 of base 16. To provide internal rigidity and support, cylindrical base stanchions 60 (FIGS. 3 and 4) are spaced from base side wall 62 and extend perpendicular to inner surface 64 of the bottom of base 16. End portions 66 of stanchions 60 insert into inlets 68 of downwardly projecting support lugs 69, which depend from the interior wall of top 14.

Face 70 of base 12 has a dial recess 72 (as more particularly shown in FIGS. 5 and 7) comprising an inwardly extending integrally molded outer circumferential wall 74, a stop shelf 76, an inwardly extending inner circumferential wall 78, and a bearing support flange 80. The dial portion 90 of noise actuator 92 is accomodated by recess 72.

Rotary dial, noisemaker assembly 99 includes elongated injection molded plastic guide bushing 100, best shown in FIGS. 5 and 9, which has somewhat flexible metal upper ears 102, 104 that are disposed diametrically opposite each other radially on the outer surface of bushing 100. Lower ears 106, 108 are disposed diametrically opposite each other on the outer surface of bushing 100, rotated at 90° from upper ears 102, 104 and spaced from them a distance equal to or slightly greater than the thickness of bearing flange 80. Each of upper ears 102, 104 has a downwardly projecting upper detent 110, and each of lower ears 106, 108 has upwardly projecting lower detent 112.

As shown in FIG. 7, bearing support flange 80 has a keyway opening 114 sized to accomodate upper ears 102, 104 and the cylinder of bushing 100, such that, when bushing 100 is inserted through keyway 114 from below, upper ears 102, 104 pass through keyway 114 but lower ears 106, 108 do not. As bushing 100 is rotated 45°, upper detents 110 and lower detents 112 at first cause both upper ears 102, 104 and lower ears 106, 108 to deflect slightly in a springlike fashion which deflection is corrected when detents 110 and 112 snap into depressions 116 provided in flange 80, thereby sandwiching bearing flange 80 between upper ears 102, 104 and lower ears 106, 108, and locking bushing 100 perpendicular to bearing flange 80.

Circular numeral disc 122 has printed numerals (not shown) on its face, lies flat on stop flange 76 and has central aperture 125 that is concentric with bushing 100. The numerals are disposed on numeral disc 122 so as to be visible through finger holes 124 of dial 90; and numeral disc 122 has a notch 123 at its outer circumference that engages integral plastic lug 126 (FIG. 7) disposed at the joint of outer circumferential wall 74 and stop shelf 76, which indexes numeral disc 122.

Clicker disc 140 (made of, e.g., injection molded plastic) has disposed about its circumference 141 twelve integral tabs 142, each of which is flush with upper surface 144, and each of which projects downward from lower surface 146. Each tab 142 projects radially beyond circumference 141.

In the center of clicker disc 140 is rivet hole 148, into which end 150 of metal rivet striker 152 is inserted from below, such that shoulder 154 bears against lower surface 146. Heading over end 150, as shown in FIG. 4, secures striker 152 to disc 140. Disc 140 also has four prong receiving holes 160 radially disposed at 90° from each other, equidistant from the center of disc 140, and sized so as to receive prongs 162 disposed about the end of cylindrical plunger shaft 164 which is integral with and extends downwardly from dial 90, as shown in FIGS. 5 and 6.

When noisemaker assembly 99 is assembled, compression spring 170 is disposed concentrically about plunger 164 (which itself is disposed concentrically within and supported by bushing 100), with its upper coils disposed within spring recess 172 of dial 90 extending about plunger 164 and its lower end bearing against upper ears 102, 104 and spring bearing 120.

Spring 170 is maintained in a partly compressed state when plunger 164 is pushed downward so as to insert prongs 162 through prong receiving holes 160. Prongs 162 are fastened to disc 140 after insertion into holes 160. Plunger 164 has a length greater than the length of said backing 100 and the distance from the stop shelf 76 to the end 101 of bushing within the base. The compression of spring 170 biases dial 90 outward from recess 72 so as to space it from stop shelf 76 with disc 140 abutting the end 101 of the bushing 100.

As shown in FIG. 4, metal bell 180 is supported by bell support post 182 integral with bottom 16 of base 12, the lug head 184 of which is inserted through hole 179 in the center of bell 180. Lug head 184 also inserts into downwardly projecting post 186, thereby securing bell 180 upon shoulder 188 of bell post 182. Washer 189 (perferably made of plastic form, but may also be made of felt or rubber) is placed intermediate bell 180 and shoulder 188 in order to damper undue vibration and permit a clearer tone. Thus assembled and mounted, side 190 of bell 180 is spaced from tip radius 192 of striker 152.

Clicker reed 200 (made of, e.g., vinyl) is in the form of a rectangle with a corner cut off at an angle so as to create a side 202 that is parallel to the axis of striker assembly 99 when reed 200 is positioned in reed stanchion 204. Reed stanchion 204 is integral with, and perpendicular to, inner surface 64 of base 116 and has fingers 206 that form pocket 208, sized to accomodate reed 200.

Assembly

To assemble rotary dial noisemaker assembly 99, head 150 of striker 152 is inserted through hole 148 and headed over. Bushing 100 is inserted through keyway 114 in flange 80 and rotated so as to snap detents 110 and 112 into depressions 116, thereby locking bushing 100 perpendicular to flange 80. Numeral disc 122 is glued into dial recess 72 so that notch 123 engages lug 126. Next, spring 170 is placed about bushing 100 and plunger 164 of dial 90 is inserted within spring 170 and through bushing 100, with prongs 162 being inserted into prong receiving holes 160 and being ultrasonically staked in place.

With respect to the subassemblies in bottom 16, bell 180 is placed on support post 182, with lug head 184 projecting through hole 179.

Reed 200 is inserted in stanchion 204 and is secured in place by adhesive applied at the bottom of the reed stanchion 204. Knot 39 is tied in cord 30, which is laid into port 36.

Next, top 14 (including assembly 99) is placed on bottom 16, with tongue 50 aligned in groove 54, stanchions 60 inserted into lugs 69, and lug head 184 inserted into post 186. All joints between top 14 and bottom 16 are ultrasonically welded. Finally, cord anchor 34 and end 31 of cord 30 are inserted through port 32 of handset 28.

Operation

In operation, a child may push dial 90, which causes striker 152 to strike bell 180. The child may also rotate dial 90, thereby causing tabs 142 to engage reed 200, thereby creating a clicking noise. Because side 202 of reed 200 is parallel to the axis of noisemaker assembly 99, tabs 142 remain proper alignment with reed 200, and thus capable of creating a clicking noise regardless of whether the child simultaneously pushes dial 90.

Toy telephone 10, therefore, provides children with a noisemaking toy that makes two distinct noises simultaneously or separately, and which makes those noises by both rotary and axial actuation of a single mechanism.

Yet other embodiments of this invention will occur to those skilled in the art, and are within the scope of the following claims.

What is claimed is:

1. A toy telephone comprising a base, a dial connected to said base and having a rotary surface and noise generating means within said base actuable by said dial, characterized in that said dial is connected to said base for both rotary and axial motion relative to said base and said noise generating means within said base is actuable to generate one noise upon rotary actuation of said dial, and said noise generating means within said base is actuatable to generate a different noise upon axial actuation of the rotary surface of said dial.

2. The toy telephone claimed in claim 1 further characterized in that said noise generating means comprises a striker connected within said base to said dial for axial movement with said dial, and a bell mounted within said base to be struck by said striker upon depression of said dial.

3. The toy telephone claimed in claim 2 further characterized in that a spring is connected between said dial and said base biasing said dial away from said base.

4. The toy telephone claimed in claim 1 further characterized in that said base has an opening therethrough, said dial comprises a plunger shaft extending through said opening, within said base a disc is connected to said shaft said disc having a plurality of tabs radially extending therefrom, within said base a striker is connected to said shaft, and spring means are connected between said base and said dial biasing said dial away from said base.

5. The toy telephone claimed in claim 4 further characterized in that a reed is mounted within said base positioned for engagement by said tabs upon rotation of said dial and a bell is mounted within said base for engagement by said striker upon axial depression of said dial.

6. The toy telephone cliamed in claim 5 further characterized in that an elongated tubular guide bushing extends through said opening and is connected to and supported by said base and said plunger shaft extends through said bushing, said plunger shaft having a length greater than the length of said bushing.

7. A toy telephone comprising a base, a dial connected to said base and noise generating means within said base actuatable by said dial, characterized in that said dial is connected to said base for both rotary and axial motion relative to said base, and said noise generating means within said base is actuatable to generate one noise upon rotary actuation and a different noise upon axial actuation of said dial, said base having an opening therethrough, said dial comprising a plunger shaft extending through said opening, within said base a disc is connected to said shaft, said disc having a plurality of tabs radially extending therefrom, and a reed is mounted within said base positioned for engagement by said tabs upon rotation of said dial and within said base a striker is connected to said shaft, and spring means are connected between said base and said dial biasing said dial away from said base, and a bell is mounted within said base for engagement by said strike upon axial depression of said dial.

8. The toy telephone claimed in claim 7 further characterized in that an elongated tubular guide bushing extends through said opening and is connected to and supported by said base and said plunger shaft extends through said bushing, said plunger shaft having a length greater than the length of said bushing.

9. A toy telephone comprising a base, a dial connected to said base and noise generating means within said base actuatable by said dial, characterized in that said dial is connected to said base for both rotary and axial motion relative to said base and said noise generating means within said base is actuable to generate one noise upon rotary actuation and a different noise upon axial actuation of said dial, said noise generating means comprising a plurality of tabs connected within said base to said dial for rotation with said dial, and a flexible reed mounted within said base that is engaged by said tabs.

10. The toy telephone of claim 9 further characterized in that said noise generating means comprises a disc connected within said base to said dial for rotation with said dial and said disc, and said tabs are integral with said disc and extend radially therefrom.

11. The toy telephone claimed in claim 2 further characterized in that said noise generating means comprises a striker connected within said base to said dial for axial movement with said dial, and a bell mounted within said base to be struck by said striker upon depression of said dial.

12. The toy telephone claimed in claim 11 further characterized in that a spring is connected between said dial and said base biasing said dial away from said base.

13. The toy telephone claimed in claim 2 further characterized in that said base has an opening therethrough, said dial comprises a plunger shaft extending through said opening, within said base a disc is connected to said shaft said disc having a plurality of tabs radially extending herefrom, within said base a striker is connected to said shaft, and spring means are connected between said base and said dial biasing said dial away from said base.

* * * * *

UNITED STATES PATENT AND TRADEMARK OFFICE

CERTIFICATE OF CORRECTION

PATENT NO. : 4,713,035

DATED : December 15, 1987

INVENTOR(S) : Paul Thom

It is certified that error appears in the above-identified patent and that said Letters Patent are hereby corrected as shown below:

Column 2, line 28, "accomodated" should be -- accommodated --.

Column 2, line 45, "accomodate" should be --accommodate --.

Column 3, line 52, "accomodate" should be -- accommodate --.

Column 5, line 31, "strike" should be -- striker --.

Column 6, line 34, "herefrom" should be -- therefrom --.

Signed and Sealed this

Twenty-eighth Day of February, 1989

*Attest:*

DONALD J. QUIGG

*Attesting Officer*

*Commissioner of Patents and Trademarks*